United States Patent [19]

Barnes

[11] 3,991,677

[45] Nov. 16, 1976

[54] PRINTING SCREEN AND TENSIONING MEANS

[76] Inventor: Vincent H. Barnes, 1322 Linda Rosa St., Los Angeles, Calif. 90021

[22] Filed: Apr. 17, 1975

[21] Appl. No.: 569,141

[52] U.S. Cl. ..... 101/127.1; 101/415.1

[51] Int. Cl.[2] ..... B41F 15/36

[58] Field of Search ..... 101/127, 127.1, 128.1, 101/415.1; 38/102–102.91; 26/54 R, 54 B

[56] References Cited

UNITED STATES PATENTS

| | | | |
|---|---|---|---|
| 1,937,750 | 12/1933 | Elliot | 101/127.1 |
| 2,218,451 | 10/1940 | Heyne | 101/415.1 X |
| 2,916,990 | 12/1959 | Du Bois | 101/415.1 |
| 3,110,255 | 11/1963 | Jeschke et al. | 101/415.1 |
| 3,416,445 | 12/1968 | Krueger, Jr. | 101/128.1 |
| 3,507,062 | 4/1970 | Moyer | 101/127.1 X |
| 3,788,216 | 1/1974 | Lambert | 101/127.1 |

*Primary Examiner*—Clifford D. Crowder
*Assistant Examiner*—R. E. Suter
*Attorney, Agent, or Firm*—Lyon & Lyon

[57] ABSTRACT

A printing screen and tensioning means including a rigid frame structure formed of channel shaped side members joined at the corners of the frame structure; the underside of each frame member receiving a parallelogram structure, each parallogram structure having a first and second side member connected by pivot links; the first side member being disposed adjacent the inner margin of the frame member and longitudinally movable by a screw drive; the second side member being guided for transverse movement in the frame member to and from the first member and having continuous screen attachment means; the printing screen having a continuous clip element at each side received on the attachment means, whereby upon operation of the screw drives the second side member applies a laterally outward force for uniformly stretching a corresponding side of the printing screen.

7 Claims, 6 Drawing Figures

PRINTING SCREEN AND TENSIONING MEANS

BACKGROUND OF THE INVENTION

Screen printing frames have had extensive use for many years. The typical frame is formed of wooden strips which are joined at their corners to form a rectangular frame of greater dimension than the area to be printed. A screen, usually a fine silk screen, which has been prepared for printing is placed over the frame and tacked in place while some manual stretching force is applied to the screen. When in use, the screen is at the bottom of the frame so as to rest on the material to be printed. The frame serves to confine the printing ink which is worked back and forth to force ink through the porous areas of the printing screen, then finally the screen and frame is removed for reuse. Usually, once the printing screen has been attached to a frame it remains attached and when not in use is stored in its frame.

It is often desired to do multiple color screen printing using several frames. For this purpose it is customary to provide reference marks on the set of printing screens, then attempt to register succeeding frames by appropriate stops on the printing table, or each frame is placed on a second metal frame and position for registering by set screws. After a run is completed each member of a set of printing frames must be stored in the two frames requiring increased storage space and added cost as these frames are not available for other use. While the outer frames may be removed, if an additional run is made, the tedious chore of re-registering the printing screens is required.

SUMMARY OF THE INVENTION

The present invention is directed to a printing screen and tensioning means, which overcomes disadvantages present in conventional screen printing equipment and is summarized in the following objects:

First, to provide a printing screen and tensioning means which includes a novel continuous retainer clip arranged to be secured to each side of a printing screen.

Second, to provide a printing screen and tensioning means, as indicated in the preceeding object, which includes a frame structure having novel means for receiving the retainer clips and applying uniform stretching force along each side of the screen.

Third, to provide a printing screen and tensioning means as indicated in the other objects, wherein the stretching means may be readily manipulated to effect registering of a set of printing screens for multicolor screen printing.

Fourth, to provide a printing screen and tensioning means, as indicated in the other objects, wherein the retainer clips may be utilized to store the printing screens by use of an inexpensive cover member such as cardboard.

The printing screen and tensioning means includes a printing screen 1 having a printing area 2 and a marginal frame 3 the corners of which are notched. The screen per-se, is conventional and is usually formed of finely woven silk. Deposited on the printing area is whatever subject matter it is desired to print, portions of the screen being sealed and other portions exposed so that ink placed on top of the screen may be forced through the screen onto an underlying surface. The screen is rectangular or square in configuration.

Figure 6:
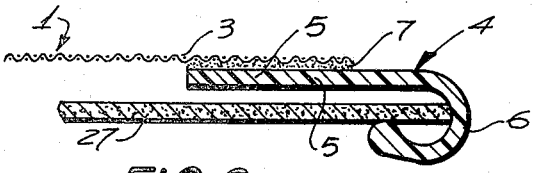
FIG. 6 is an enlarged fragmentary sectional view of a margin of the printing screen.

For purposes of the present invention each side of marginal frame 3 receives an elongated retainer clip or reinforcing strip 4 which may be formed of extrudent plastic. The retainer clip includes a flat portion 5 and a semicircular margin 6 forming a hook. In the structure shown four such retainer clips are provided, each joined to a corresponding side of the marginal frame 3 by cement 7 as indicated in FIG. 6. Care is taken to place the retainer clip 4 in parallel relation to the corresponding side of the printing area 2.

The printing area 2 is surrounded by a frame structure 8 formed of channel shaped side members 9, each channel member including parallel side flanges 10 and a connecting web 11.

Each side member receives a parallelogram structure 12 which includes a drive bar 13 is movable lengthwise and which may be channel shaped in cross-section. Each drive bar is placed adjacent the laterally inner flange of the corresponding side member. One end of the drive bar 13 receives an end fitting 14 extending lengthwise therefrom, the end fitting having a screwthreaded socket which receives a screw 15, extending transversely through an adjacent channel member 9 and terminates in a head 16. Rotation of the head 16 causes longitudinal movements of the drive bar 13 with respect to its corresponding side member 9.

Also forming a part of each parallelogram structure 12 is a transversely movable tension bar 17 which is also channel shaped. Formed on each tension bar 17 is a T-rib 18 forming a sloping cross portion 19 and an enlarged marginal portion 20 of circular cross section.

To complete each parallelograms structure 12, the drive bar 13 and tension bar 17 are connected by a series of links 21 joined to the bars by link pins 22.

To retain each parallelogram structure in place a series of cross pins 23 extend between and through the side flanges 10. The pins may be the type known as roll pins, which are longitudinally split so that their ends tend to bind in the side flanges 10. Each pin 23 extends slidably through a corresponding opening provided in the tension bar 17 and through a corresponding slot 25 provided in the corresponding drive bar 13.

Operation of the printing screen and tensioning means is as hereinafter described.

Figure 1:
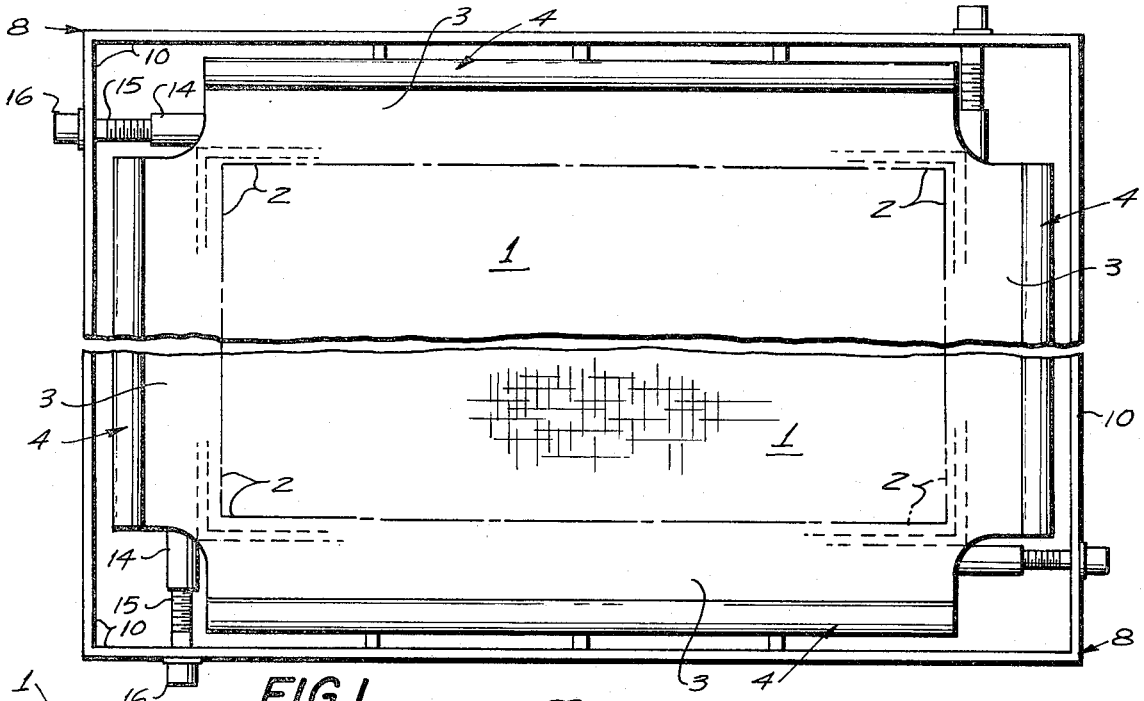
FIG. 1 is a bottom view of the printing screen and tensioning means, shown fragmentarily.
Figure 2:
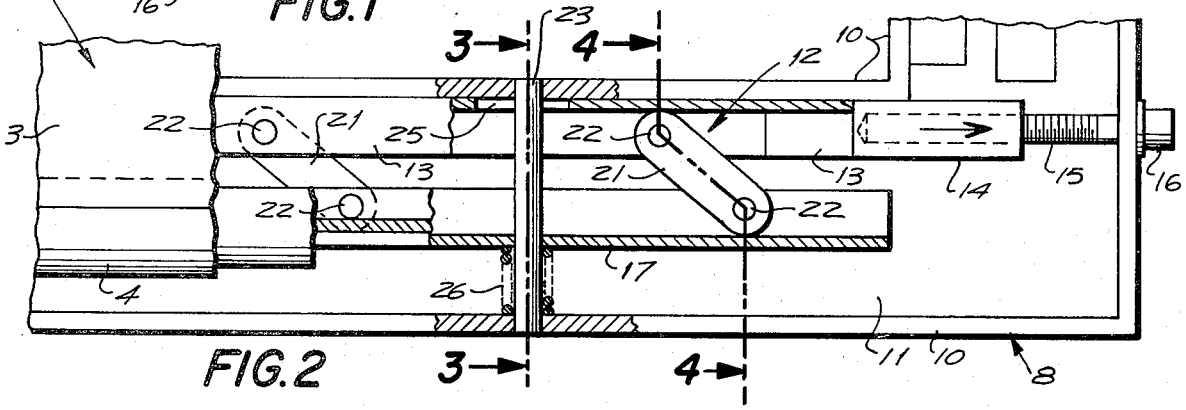
FIG. 2 is an enlarged fragmentary bottom view with portions broken away and sectioned to illustrate structural features.
Figure 3:
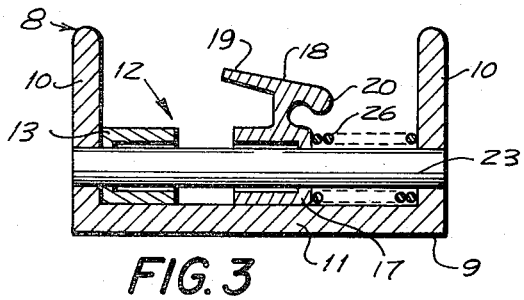
FIG. 3 is a further enlarged transverse sectional view taken through 3—3 of FIG. 2.
Figure 4:
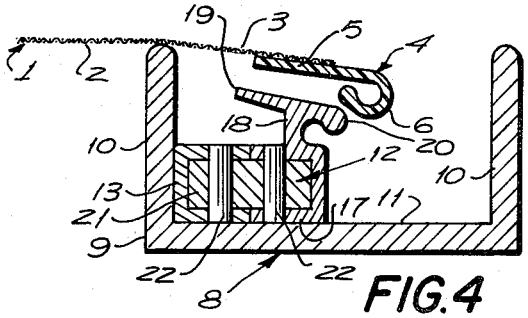
FIG. 4 is another further enlarged sectional view taken through 4—4 of FIG. 2, showing the screen tensioning means contracted to receive a retainer clip secured to a margin of the printing screen.
Figure 5:
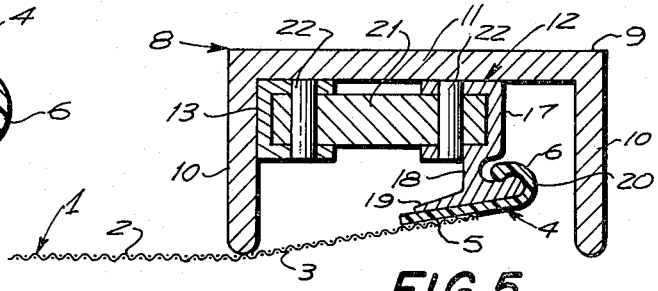
FIG. 5 is a similar cross sectional view with the frame inverted with respect to FIG. 4 to illustrate the frame in its operative position.

The frame structure 8 is placed in an inverted position with the side flanges 10 extending downward into engagement with the marginal portion of the screen 2, as shown in FIG. 5. The screen is deflected by the flanges 10 so that when the screen is tensioned the flanges 10 serve to confine the printing ink. Each parallelogram structure 12 is moved to its contracted position in which the drive bar 13 and tension bar 17 are in mutual contact or nearly so. This is accomplished by rotation of the corresponding screw 15 which moves the drive bar 13 in longitudinally. The tension bar 17, however is restrained from longitudinal movement by the cross pins 23. Springs 26 may be provided which aid contraction movement of the tension bar 17 as shown in FIGS. 2 and 3.

When each parallelogram structure is in its retracted position the semicircular margin or hook portion 6 of each retainer clip may be fitted over the enlarged margin 20 of the corresponding tension bar 17. Initially parallelogram structures 12 extending along the longer sides of the rectangular screen are adjusted to apply light transverse or crosswise tension to the printing screen and the printing screen is adjusted by contracting one parallelogram while expanding the opposite parallelogram, so that the parallelogram structure 12 is in proper registery with the underlying printing area 2. During the manipulation of the printing screen, the end parallelogram structures 12 are also employed to shift the printing screen 1 longitudinally. When the printing screen is in proper position the parallelogram structures are expanded to apply the desired tension to the printing screen.

The ability to shift the printing screen laterally or longitudinally facilitates the use of the set of printing screens for purposes of multicolor printing. Also because the printing screen is readily attached to the frame structure 8 and adjusted, it may be removed for storage, rather than to remain on the frame structure for this purpose. By reason of the hook shaped marginal portion 6, the printing screen may be held in a desirable flat condition by a cardboard or pressed wood plate 27 as suggested in FIG. 6, the margins being inserted in the hook portions 6. If cardboard is used the margins may be readily deflected for entrance into the hook portions 6, however a pair of plates may be slipped axially into the longer hook channels 6 and transversely into the shorter hooked channels. Such plates may overlap and be secured against buckling while permitting the printing screen to be under slight tension. This arrangement permits reduction in the storage space required for the printing screens and eliminates the need for storing the frame structures 8, while retaining a screen thereon.

While it is preferred to provide tensioning means along all four sides, particularly for multicolor use, two adjacent sides may be fixed.

Having fully described my invention it is to be understood that I am not to be limited to the details herein set forth, but that my invention is of the full scope of the appended claims.

I claim:

1. A printing screen and tensioning means, comprising:

a. a printing screen having a central printing area and marginal areas extending beyond the printing area;

b. a reinforcing strip secured to selected marginal areas to resist tension and including a lengthwise extending separable attachment element;

c. a frame structure having four sides and dimensioned to overlie, when in use, the marginal areas of the printing screen;

d. a parallelogram structure carried by each of the sides of the frame structure corresponding to the locations of the reinforcing strips;

e. each parallelogram structure including a drive bar restricted to movement parallel to the corresponding reinforcing strip; a tension bar restricted to movement transverse to the reinforcing strip; and links pivotally connecting corresponding drive and tension bars;

f. a longitudinally extending attachment element on each tension bar separably engageable with the attachment element of a corresponding reinforcing strip;

g. and a screw member carried by the frame structure and accessible externally thereof, the screw member being secured to the drive bar to effect movement thereof.

2. A printing screen and tensioning means, as defined in claim 1, wherein:

a. the frame structure is formed by four right-angularly disposed channel shaped side members having inner and outer flanges joined by a web and disposed, when arranged for use, with the side members extending downwardly, the inner flange engaging the printing screen.

3. A printing screen and tensioning means, as defined in claim 2, wherein:

a. the drive bars are disposed contiguous to the inner flanges of the side members;

b. said screw member extends in alignment from one end of each drive bar across the adjacent side member for external access to effect movement of the corresponding drive bar thereby to adjust the tension of the printing screen;

c. and each side member is provided with transverse guide means to confine the corresponding tension bar to movement to and from the printing screen.

4. A printing screen and tensioning means, comprising:

a. a printing screen having a central printing area bordered by marginal areas;

b. a frame structure having sides overlying the marginal areas and having coplanar lower edges engaging the marginal areas;

c. a parallelogram structure carried by each of selected sides of the frame structure;

d. each parallelogram structure including a tension bar, extending lengthwise with respect to each selected side of the frame structure, and cross pins extending crosswise thereto for guiding the tension bar to and from the corresponding marginal area of the printing screen;

e. each parallelogram structure also including a drive bar extending parallel to the tension bar, means for guiding the drive bar in a direction lengthwise of the tension bar, and link members joining the drive bar and tension bar to effect uniform movement of the tension bar to and from the corresponding marginal area of the printing screen upon lengthwise movement of the drive bar;

f. attachment means joining the tension bar to the corresponding marginal area of the printing screen;

g. and an operating member extending from the drive bar and carried by the frame structure to cause lengthwise movement of the tension bar to effect uniform stretching of the printing screen.

5. A printing screen and tensioning means, as defined in claim 4, wherein:

a. the frame structure includes four sides in right angular relation;

b. two marginal areas of the printing screen are fixed;

c. and the remaining two marginal areas form said selected sides and are attached to said parallelogram structures.

6. A printing screen and tensioning means, as defined in claim 4, wherein:

a. the frame structure includes four selected sides in right angular relation;

b. and a parallelogram structure is provided at each of the four sides of the frame structure.

7. A printing screen and tensioning means, as defined in claim 4, wherein:

a. said attachment means includes a hook element and a rib element, the elements being releasibly engageable and coextensive with a corresponding marginal area.

* * * * *